US005280794A

United States Patent [19]

Degen

[11] Patent Number: 5,280,794

[45] Date of Patent: Jan. 25, 1994

[54] APPLIANCE FOR SUPPORTING WOMEN DURING CHILDBIRTH

[75] Inventor: Paul Degen, Liestal, Switzerland

[73] Assignee: Michael Bischof, Liestal, Switzerland

[21] Appl. No.: 965,782

[22] Filed: Oct. 23, 1992

[30] Foreign Application Priority Data

Oct. 24, 1991 [CH] Switzerland ..... 3108/91

[51] Int. Cl.[5] ..... A61G 15/00

[52] U.S. Cl. ..... 128/845

[58] Field of Search ..... 128/875, 870, 869, 874, 128/845; 602/32, 33, 34, 35, 36, 39, 40; 5/120, 121, 122, 124, 625, 81.1

[56] References Cited

U.S. PATENT DOCUMENTS

| | | | |
|---|---|---|---|
| 913,127 | 2/1909 | Haas | 602/32 |
| 2,905,715 | 8/1960 | Brobeck | 5/120 |
| 3,167,068 | 1/1965 | Carr | 602/32 |
| 3,638,647 | 2/1972 | Creelman | 128/845 |
| 3,701,395 | 10/1972 | Theobald | 128/845 |
| 4,205,665 | 6/1980 | Burton | 602/35 |
| 4,343,299 | 8/1982 | Oxendine | 128/845 |
| 4,825,855 | 5/1989 | Kundson | 128/845 |
| 5,097,545 | 3/1992 | Hooi | 5/122 |

*Primary Examiner*—Michael A. Brown

*Attorney, Agent, or Firm*—Wenderoth, Lind & Ponack

[57] ABSTRACT

An appliance for supporting a woman during childbirth includes a flexible supporting part of flat design for supporting the woman's back, buttocks and thighs. Attached to the supporting part are suspension elements by means of which the supporting part can be suspended. The supporting part preferably has a basic shape in the form of an elongate quadrilateral, with two longitudinal sides, a head side and a leg side. The leg side is bent in or recessed thereby forming two tabs which are intended for supporting the thighs and between which the child-bearing region in the vicinity of the woman's vagina remains freely accessible. By adjusting the suspension height of the head side or leg side, the position of the supporting part and therefore the woman's position can be selected, any position from an upright posture to a supine position being possible.

23 Claims, 4 Drawing Sheets

APPLIANCE FOR SUPPORTING WOMEN DURING CHILDBIRTH

BACKGROUND OF THE INVENTION

The invention relates to an appliance for supporting a woman during childbirth.

As is known, women in childbirth are nowadays supported almost exclusively in the lying position. However, experts have repeatedly pointed out, more recently with greater force, that the supine position is for the child-bearing woman a questionable and disadvantageous position which entails a number of considerable disadvantages in the course of the birth process and which, moreover, in no way corresponds to the natural position.

The preference for the lying child-bearing position is without doubt due, on the one hand, to the development of clinical obstetrics in the past few decades. But on the other hand, there is also a lack of appliances, by means of which a child-bearing woman can be supported suitably and comfortably in an upright child-bearing posture in accordance with current medical requirements. Furthermore, an appliance allowing an upright child-bearing posture must at the same time also permit a lying position, if necessary, for example for a surgical operation when complications occur.

SUMMARY OF THE INVENTION

The main object of the present invention is, therefore, to provide an appliance for supporting a woman during childbirth, which satisfies the above-mentioned requirements and which, in particular, allows an upright child-bearing posture that is as comfortable as possible. At the same time, the appliance is to be designed in a simple way and to be suitable both for clinical use and for home births.

This object is achieved by means of the invention as described below:

BRIEF DESCRIPTION OF THE INVENTION

An exemplary embodiment of the invention is described below by means of the accompanying drawings. In these:

FIG. 1 shows diagrammatically a perspective front view of a woman supported in an appliance according to the invention, FIG. 2 is a top view of an exemplary embodiment of the invention, in an arrangement stretched flat, FIG. 3 is a side view of an appliance according to the invention, with a woman in an upright child-bearing position, FIG. 4 is a side view of an appliance according to the invention, with a woman in a lying position, FIG. 5 is a perspective representation of a special embodiment of the invention, FIG. 6 shows in perspective and partially cut away an embodiment of a supporting part having a stiffening element in thigh and buttock regions, and FIG. 7 is a similar view and shows a further version of a special embodiment of the invention.

DETAILED DESCRIPTION OF THE INVENTION

Figure 1:
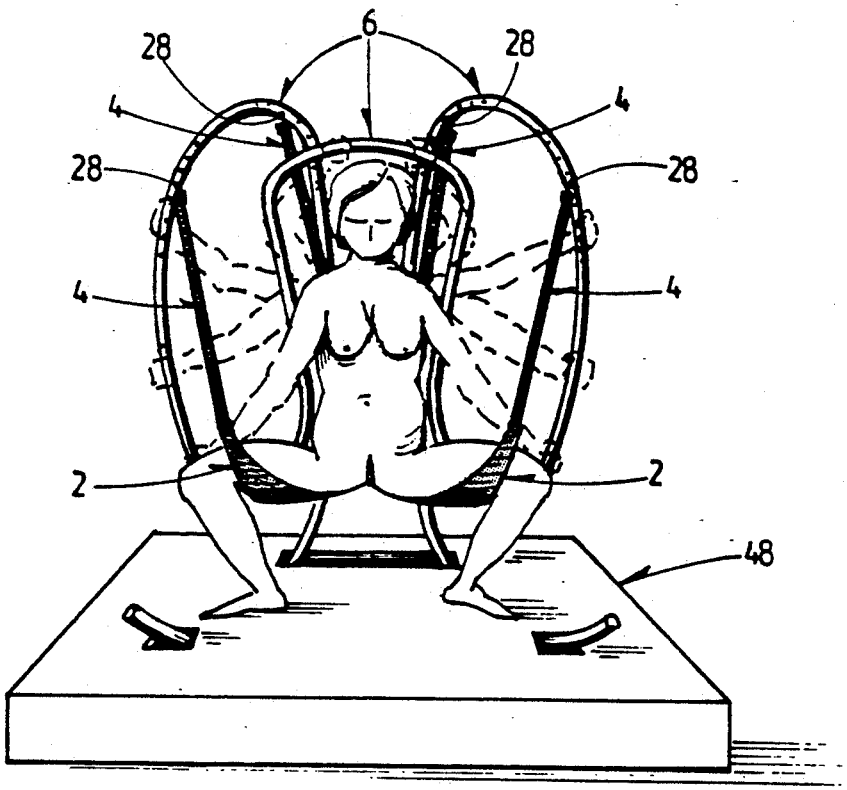

FIG. 1 shows a woman who is supported in an upright child-bearing posture in a flexible supporting part 2 which is of flat design and which supports her at the back, at the buttocks and under the thighs, but leaves free the child-bearing region in the vicinity of the vagina. The supporting member or part 2 is suspended in a frame 6 by means of suspension elements 4. The frame 6 is part of a special embodiment of the invention and is described in more detail further below.

Figure 2:
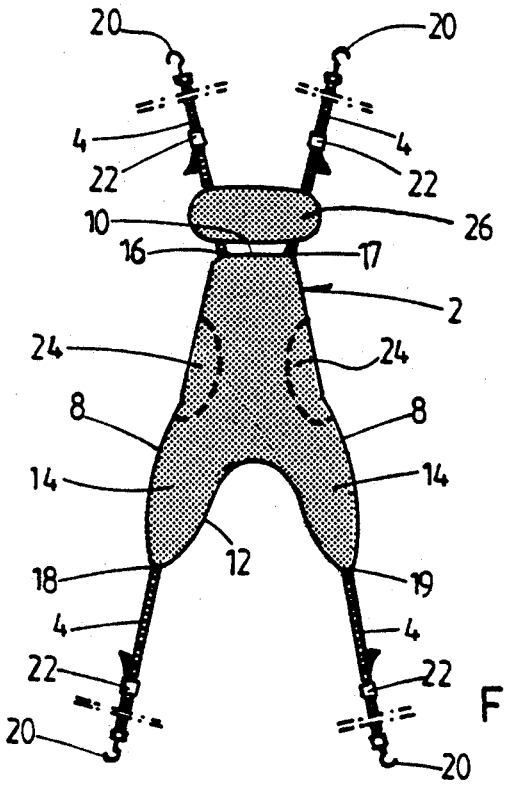

The appliance according to the invention can be seen better in FIG. 2 which shows, in a top view, an exemplary embodiment with the supporting part 2 laid flat and with the four suspension elements 4. The basic shape of the supporting part 2 is essentially an equilateral trapezium with two longitudinal sides or edges 8, a head side or edge 10 and a leg side or edge 12. The leg side 12 is preferably bent in or curved inwardly towards the center of the supporting part, thereby forming two tabs 14 which are intended for supporting the woman's thighs. The bent-in portion of the leg side 12 ensures that the child-bearing region in the vicinity of the vagina is exposed and nevertheless the thighs are supported as effectively as possible by the tabs 14.

Belts 4, for example made of a synthetic fabric, serving as suspension elements are fastened to each of the four corner regions 16, 17, 18 and 19 of the supporting part 2. Hooks 20 can be attached to opposite ends of the belts 4, as shown. Advantageously, the length of the suspension elements is adjustable. This is true, in the present exemplary embodiment, by the belts being adjustable by belt buckles 22.

The supporting part 2 can be designed, for example, in the manner of a thinly upholstered mat of a synthetic fabric which is equipped with an exchangeable cloth covering. According to a preferred embodiment, upholsteries or padding 24 which additionally support the woman's body are formed in the side portions of the supporting part 2. Upholsteries of this type are, of course, also possible at other locations of the supporting part, for example in the region of the neck or in the buttock region.

To complete the support of the woman's head, advantageously a head cushion 26 fastened to the two belts 4 located on the head side can be arranged above the head side 10 of the supporting part 2. To allow the appliance to be used with or without a head cushion, touch-and-close connections are expediently suitable for fastening purposes.

As can already be seen in FIG. 1, the supporting part 2 is attached at suspension points 28 by means of the suspension elements 4, in such a way that it can hang freely, and on the one hand the two corner regions 16 and 17 on the head side and on the other hand the two corner regions 18 and 19 on the leg side are each located at the same height. The supporting part 2 thus constitutes a kind of sitting or lying mat, on which the woman can take her place. The woman's legs can spread apart over the longitudinal sides 8 of the supporting part, thereby affording the desired childbearing posture and at the same time a safe and comfortable support. As a result of the woman's body weight, the flexible supporting part is brought into a stable position, the form and orientation of which are determined by the position of the corner regions 16 to 19 or by the position of the suspension points 28.

Figure 3:
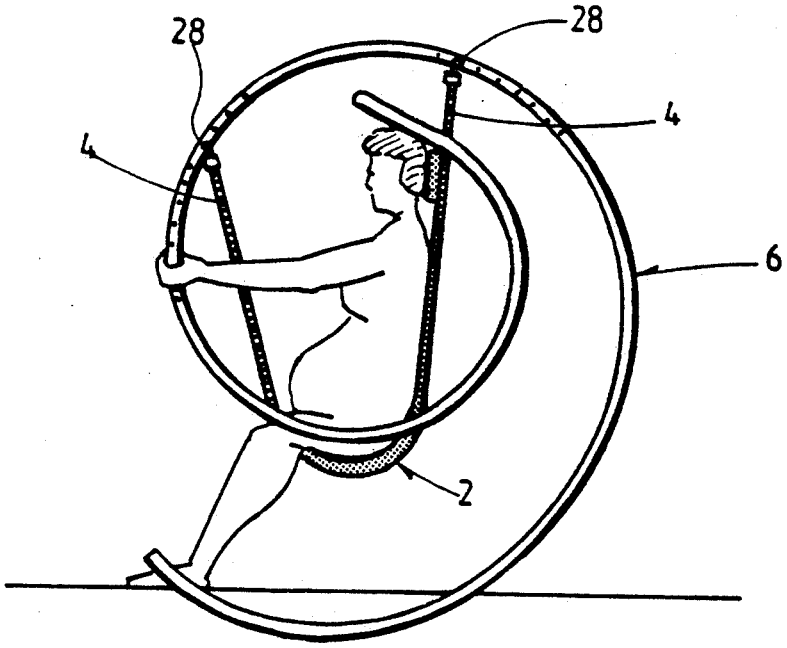
Figure 4:
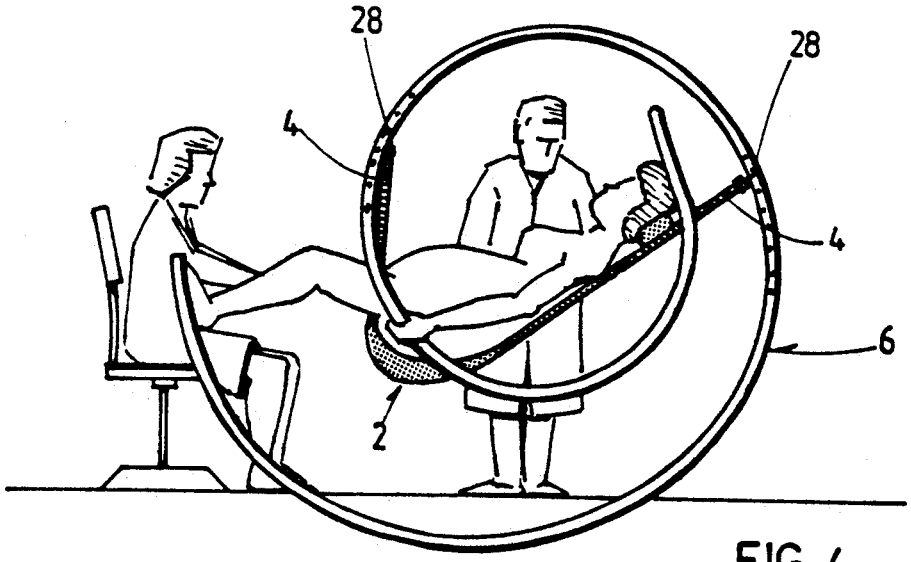

FIGS. 3 and 4 show two examples of different possible stable positions of the supporting part 2. Depending on the mutual position of the corner regions 16, 17 and 18, 19 located on the head side and on the leg side respectively, the position of the supporting part 2 and therefore the woman's position can be selected, any positions from an upright posture through reclining positions to a completely supine position being possible. If, for example, as shown in FIG. 3, the corner regions 16, 17 located on the head side are positioned substantially higher than the corner regions 18, 19 located on the leg side, an upright posture is obtained. In contrast, if, as shown in FIG. 4, all four corner regions are approximately at the same height, a lying position is obtained. The position of the corner regions 16, 17, 18, 19 can be adjusted according to the particular use either by varying the length of the suspension elements 4 or by displacing the suspension points 28.

Figure 6:
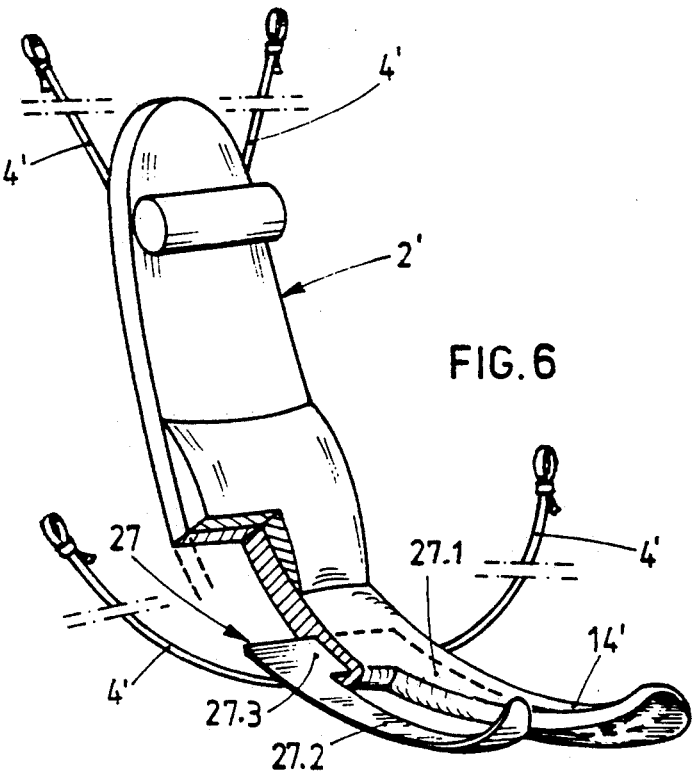

Although the legs are shown here as spread apart completely over the longitudinal sides of the supporting part, so that the suspension elements extend on the inside of the legs, it is equally possible to place the thighs in such a way that the suspension elements extend on the outside. In order to promote this posture in a special way, there can be inserted in the thigh regions and, if appropriate, in the buttock region of the supporting part a stiffening element which stabilizes these regions and which, by means of its shape, counteracts a possible slipping off of the thighs. FIG. 6 shows such a version of a supporting part, designated as a whole by 2'. A stiffening element 27 extends with thigh portions 27.1 and 27.2 within respective tabs 14' supporting the thighs, and the two thigh portions are connected to one another by means of a buttock portion 27.3. The stiffening element can, for example, be a plastic molding. Since, in this embodiment, the thigh regions of the supporting part inherently have sufficient stability, the two lower suspension elements 4', do not necessarily have to be fastened to the front end of the tabs 14', but, as shown, can also be attached approximately in the middle of the thigh regions.

The above-described possibility for adjusting the posture of the child-bearing woman in a way which is simple to carry out, and the possibility of an upright child-bearing posture are particular advantages of the appliance according to the invention. The upright child-bearing posture can be preferred for births taking place normally, whilst a lying position can be adopted, for example, when complications occur or for making a perineal incision.

Furthermore, the appliance according to the invention advantageously allows good access to the child-bearing woman from all sides, for example for assistance from the rear, for example by the husband, or for supervision and any operation by a physician or midwife from the front. Good access is also further improved by the flexibility of the supporting part. Moreover, the flexible supporting part fits the shapes of the woman's body in an excellent way and is therefore extremely comfortable, and furthermore the woman remains mobile and can make small changes in position solely by shifts of weight and thereby gain some relief.

It should be stressed that the appliance according to the invention does not have to be suspended in the special frame 6 shown, but can also be suspended in a completely different way, for example on the room ceiling or in a simple structure composed of rods or of bars. Moreover, if a structure of this type is made collapsible, it can easily be transported together with the appliance according to the invention, thus allowing simple use even for home births.

However, the preferred embodiment of the invention shown in FIGS. 1, 3 and 4, with the special design of the frame 6, affords some further advantages in addition to an aesthetically attractive shape and will therefore now be described in more detail by means of FIGS. 5 and 7. The frame consists of two identical tube frame portions in the form of or rod segments 6.1 and 6.2 which are bent spirally and which extend essentially in respective vertical planes. The two tube or rod segments 6.1, 6.2 are at a distance from one another, so that the supporting part 2 is accommodated between them, and are connected to two transverse connection elements 30 and 31. In addition, the inner spiral turns of the two tube or rod segments 6.1, 6.2 are connected in one piece to a bent connecting segment 6.3. Appropriately, the two vertical planes, in which the tube or rod segments 6.1 and 6.2 extend, are at an angle to one another which opens towards the leg side of the supporting part and which is in the range of 20 to 60 degrees. The supporting part 2 is suspended by means of belts 4 on the outer spiral turns of the two tube or rod segments 6.1, 6.2 at suspension points 28. So that the supporting part can be suspended in different positions, as required, a series of different possible suspension points is respectively provided.

The lower regions of the two tube or rod segments 6.1, 6.2 are each mounted on respective pairs of rollers 32 so that the frame can be rotated forwards or rearwards (arrow A) about its horizontal mid-axis in the manner of a wheel, with the result that the position of the supporting part or the position of the woman supported therein can be varied in a simple way. The frame is secured from movement in the upward direction by means of two further rollers 34. Since the lower regions of the two tube or rod segments 6.1; 6.2 do not have to run parallel, their mutual spacing distance can vary during the rotation of the frame. To take this fact into account, the rollers 32 and 34 are mounted laterally displaceably on their axles 36. The axles 36 are held in supporting elements which are fastened to a baseplate 38.

For the mechanical drive of the rotational movement of the frame, there is a spindle 40 which can be rotated by a motor 42 via a gear mechanism 44. On the spindle 40 runs a nut 46 which is held on the transverse connection element 31 of the frame. When the spindle 40 rotates, the nut 46 runs forwards or backwards and takes the transverse connection element with it, thereby bringing about the desired rotation of the frame. Since the transverse connection element 31 is displaced vertically during the rotation of the frame, on the one hand the spindle 40 is mounted vertically pivotably via the gear mechanism 44, in order thus to be capable of following the displacement of the transverse connection element 31, and on the other hand the nut 46 25 is mounted rotatably on the transverse connection element 31, in order to match the orientation of the spindle. Of course, this version of the mechanical drive is only one of many possibilities. Thus, it would likewise be possible, for example, to drive one of the rollers 32 directly.

Figure 5:
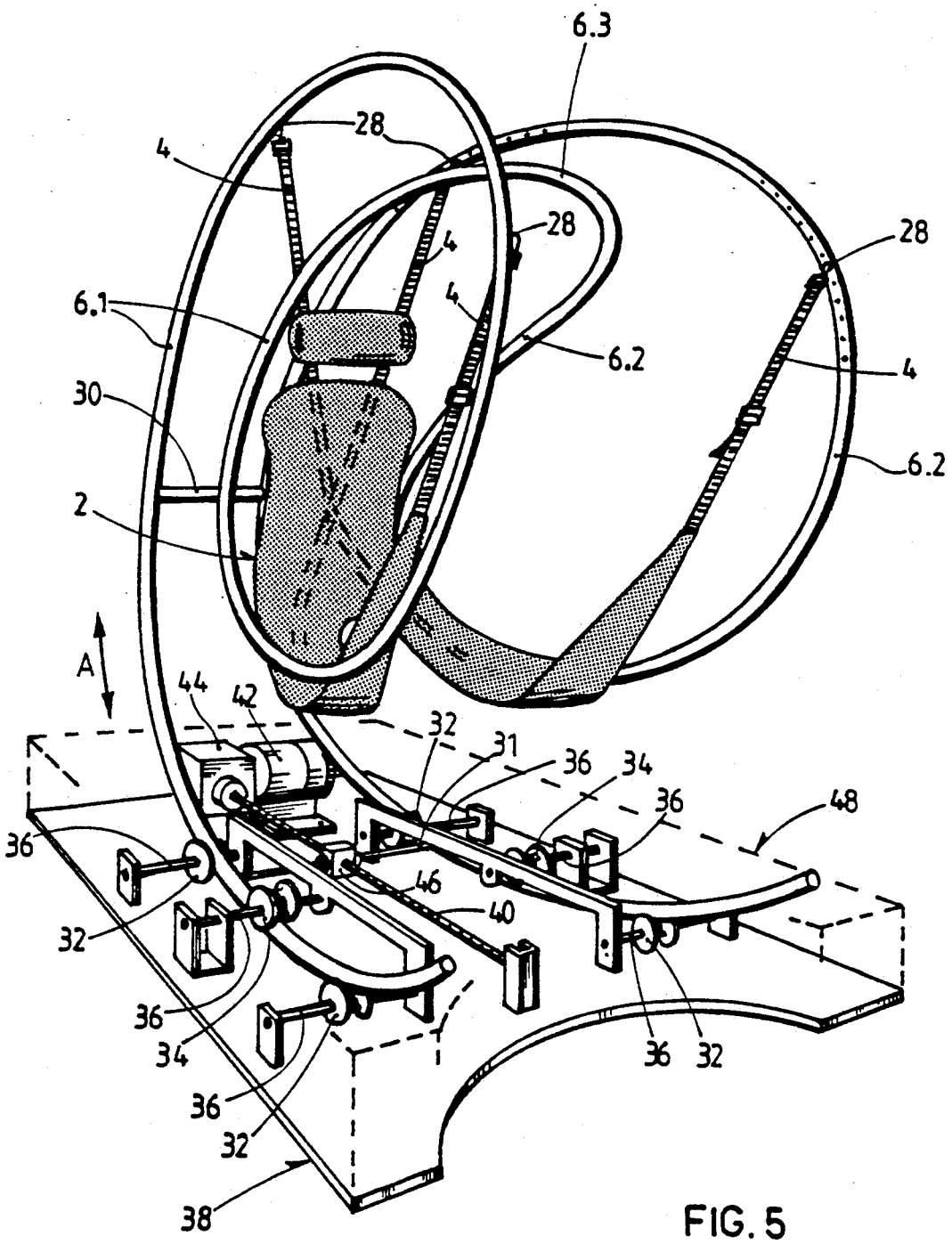

The entire drive device of the frame is preferably equipped with a cover 48, as indicated by broken lines in FIG. 5 and as shown unbroken in FIG. 1.

Figure 7:
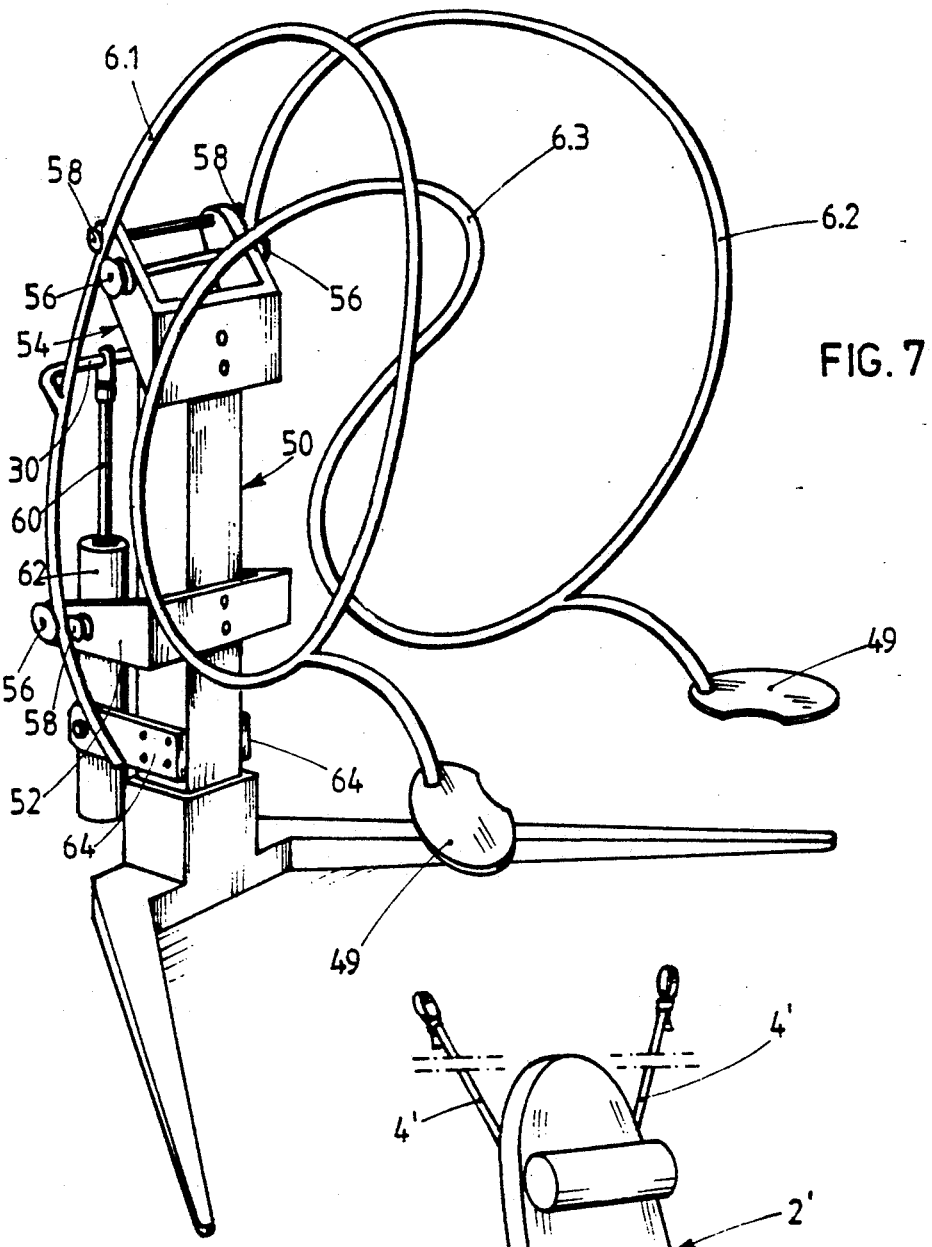

A further version for supporting and mounting the frame 6 is evident from FIG. 7. The frame itself corresponds essentially to that shown in FIG. 5, and therefore the same reference symbols are also used for corresponding parts. Once again, two spirally bent tube or rod segments 6.1 and 6.2 are arranged at a mutual distance and are connected to one another by means of a connecting segment 6.3 at the ends of their inner spiral turns and additionally by means of a transverse connection element 30. Two foot rests 49 are attached to the tube or rod segments 6.1, 6.2.

However, here the frame 6 is supported or carried by a supporting column designated as a whole by 50. The supporting column has lower and upper fork-shaped jibs 52 and 54, on the outside of each of which a roller 56 is mounted rotatably. The two rear outer regions of the spiral tube or rod segments 6.1 and 6.2 are respectively so inserted between the associated rollers 56 on the upper and lower jibs that they rest with their insides of respective rollers 56 on the upper jib 54 and with their outsides of respective roller 56 on the lower jib 52. As result of this type of mounting, the frame 6 is rotatable forwards or rearwards about its horizontal mid-axis. To secure the tubes on the rollers, each roller 56 is assigned a respective counterroller 58. A rod 60, which engages on the transverse connection element 30, holds the frame in a specific rotary position. To vary the rotary position, the rod 60 can be extended upwards or retracted downwards by means of a drive 62. The drive 62 is pivotably mounted in holders 64 fastened to the supporting column 50, so that the rod and drive can follow the movement of the frame.

So that the frame is additionally also movable vertically, it is expedient to design the supporting column 50 as a lifting column, so that the entire appliance can be raised or lowered in relation to the floor.

The described and illustrated special design of the frame and its mounting on rollers affords various advantages. Thus, the two spirally bent tube or rod segments 6.1, 6.2 and the connecting segment 6.3 give the woman very many different possibilities of holding positions for her hands, for example overhead, at the side, to the front and especially also underneath. This is illustrated in FIG. 1 by the different arm positions indicated by broken lines. The bent tube or rod segments 6.1, 6.2 then have a resilient effect which additionally increases the comfort of the appliance according to the invention. And by virtue of the mounting of the frame on rollers, the woman's position can be changed very simply and quickly according to need or requirement.

It should be mentioned, in addition, that for a mounting and rotational movement of the frame on rollers in the above-described way it is already sufficient if only those regions of the tube or rod segments 6.1, 6.2 in which the frame as a whole is supported are bent. Accordingly, other shapes for the tube or rod segments are also possible instead of a spiral, especially, for example, a ring or a ring section.

I claim:

1. An appliance for supporting a woman during childbirth, said appliance comprising;

a flexible supporting member of substantially flat configuration;

at least three suspension elements for suspending said supporting member in a support position from spaced apart suspension points located above said supporting member;

said supporting member in said support position defining a mat enabling a woman to be supported thereby in a sitting position or a reclining position, and said supporting member having respective portions for support of the back, the buttocks and the thighs of the woman in such sitting position or reclining position; and said supporting member having a basic configuration in the shape of an elongated quadrilateral having four corners defined by two longitudinal side edges, a head end edge and a leg end edge, and said leg end edge being curved inwardly to define two tabs that form said portions for support of the thighs of the woman and an open between said tabs.

2. An appliance as claimed in claim 1, comprising four said suspension elements, each said suspension element being attached to said supporting member in the region of a respective said corner thereof.

3. An appliance as claimed in claim 1, wherein quadrilateral shape of said supporting member essentially is a quadrilateral trapezium with a shorter base at said head end and a longer base at said leg end.

4. An appliance as claimed in claim 1, wherein the length of said suspension elements is adjustable.

5. An appliance as claimed in claim 1, wherein said suspension elements comprise belts, straps or bands.

6. An appliance as claimed in claim 1, wherein said supporting member further includes upholstered portions for providing additional support for the body of the woman.

7. An appliance as claimed in claim 6, wherein said upholstered portions are located along side regions of said supporting member.

8. An appliance as claimed in claim 1, wherein said portions of said supporting member for support of the thighs of the woman are equipped with a stiffening element.

9. An appliance as claimed in claim 8, wherein said portion of said supporting member for support of the buttocks of the woman is equipped with a stiffening element.

10. An appliance as claimed in claim 1, further comprising a cushion supported at a position to provide support for the head of the woman.

11. An appliance as claimed in claim 10, wherein said cushion is connected fixedly or releasably to at least one of said suspension elements.

12. An appliance as claimed in claim 1, further comprising a frame supporting said suspension elements at said suspension points and thereby suspending said supporting member in said support position.

13. An appliance as claimed in claim 12, wherein said frame comprises two frame portions spaced apart and connected by at least one transverse connection element, and said supporting member is suspended between said spaced frame portions.

14. An appliance as claimed in claim 13, wherein each said frame portion is formed of a tube or a rod.

15. An appliance as claimed in claim 13, wherein said frame portions include bent regions at which said frame is supported.

16. An appliance as claimed in claim 13, wherein each said frame portion is of a spirally curved configuration.

17. An appliance is claimed in claim 16, wherein said spirally curved frame portions have respective inner spiral ends, and said frame further comprises a connecting piece joined to said inner spiral ends.

18. An appliance as claimed in claim 13, wherein each said frame portion extends in a respective vertical plane.

19. An appliance as claimed in claim 18, wherein the vertical planes of said two frame portions extends at an angle to each other and diverge in a direction toward a leg end of said supporting member.

20. An appliance as claimed in claim 19, wherein said angle is from 20° to 60°.

21. An appliance as claimed in claim 13, further comprising at least two rollers supporting each said frame portion in a manner to enable said frame to rotate about a horizontal mid-axis thereof, thereby enabling the position of the woman supported by said suspended supporting member to be shifted between the sitting position and the inclined position.

22. An appliance as claimed in claim 21, further comprising a drive member operably connected to drive at least one said roller and thereby to rotate said frame about said mid-axis.

23. An appliance as claimed in claim 21, wherein said rollers are mounted for displacement axially thereof.

* * * * *